US006749363B1

(12) United States Patent
Petersen

(10) Patent No.: US 6,749,363 B1
(45) Date of Patent: Jun. 15, 2004

(54) AIRCRAFT SERVICE PIT LID HINGE

(75) Inventor: Craig A. Petersen, Costa Mesa, CA (US)

(73) Assignee: Dabico Inc., Costa Mesa, CA (US)

( * ) Notice: Subject to any disclaimer, the term of this patent is extended or adjusted under 35 U.S.C. 154(b) by 0 days.

(21) Appl. No.: 09/693,507

(22) Filed: Oct. 23, 2000

(51) Int. Cl.[7] ..... E02D 29/14

(52) U.S. Cl. ..... 404/25; 52/19

(58) Field of Search ..... 404/25, 26; 52/19, 52/20, 21

(56) References Cited

U.S. PATENT DOCUMENTS

| | | | | | |
|---|---|---|---|---|---|
| 945,753 | A | * | 1/1910 | Chamberlain et al. | 404/25 |
| 1,923,481 | A | * | 8/1933 | Ford | 404/25 |
| 2,883,853 | A | * | 4/1959 | Forni | 404/25 |
| 3,455,059 | A | * | 7/1969 | Evans | 404/25 |
| 5,324,135 | A | * | 6/1994 | Smith | 404/25 |
| 5,366,317 | A | * | 11/1994 | Solimar | 404/25 |
| 5,394,650 | A | * | 3/1995 | Dean | 52/20 |
| 5,465,862 | A | * | 11/1995 | Devlin | 220/335 |
| 5,507,590 | A | * | 4/1996 | Argandona | 404/25 |
| 5,600,921 | A | * | 2/1997 | Vardaro | 49/380 |
| 5,950,368 | A | * | 9/1999 | Bradford | 52/20 |
| 6,109,823 | A | * | 8/2000 | Halferty et al. | 404/25 |

FOREIGN PATENT DOCUMENTS

EP 0391826 A1 * 3/1990 ..... E02D/29/14

* cited by examiner

*Primary Examiner*—Thomas B. Will
*Assistant Examiner*—Alexandra K. Pechhold
(74) *Attorney, Agent, or Firm*—Charles H. Thomas

(57) ABSTRACT

A pit lid assembly is formed for a subsurface aircraft servicing pit and includes a lid frame formed with a flat, upper deck, a pit access opening surrounded by the deck, and a hinge pocket defined in the structure of the frame. The hinge pocket extends radially outwardly from the pit access opening and defines mutually opposing and mutually parallel pocket side walls. The pocket has a floor and an end wall slopes upwardly from the pocket floor at an obtuse angle relative to the surrounding flat deck of the frame. A pit lid is seated in the frame upon a bearing ledge formed about the periphery of the access opening. The pit lid has a hinge leaf projecting outwardly away from the access opening. Straight, narrow, linear bores are defined through the structure of both the hinge frame and the hinge leaf. These bores are in coaxial alignment with each other and reside in a horizontal plane located beneath the level of the flat, upper deck of the structure of the frame and above the level of a moisture barrier seal set into the underside of the pit lid. A hinge pin is inserted into the coaxially aligned bores in both the hinge frame and the hinge leaf. The structure of the hinge pin extends entirely through the hinge leaf and into the adjoining structure of the hinge frame. The pit lid may thereby be raised and lowered by rotation about the hinge pin, which is located beneath the surface of the surrounding deck of the frame.

15 Claims, 6 Drawing Sheets

AIRCRAFT SERVICE PIT LID HINGE

BACKGROUND OF THE INVENTION

1. Field of the Invention

The present invention relates to a heave duty hinge for an aircraft service pit lid assembly that is used to provide access to subsurface pits located beneath airport runways, docking areas, and other surfaces across which aircraft travel.

2. Description of the Prior Art

At airports and airfields throughout the world, aircraft ground support electricity, air conditioning, fuel, and other aircraft servicing necessities are provided from pits located beneath the surfaces across which the aircraft travel. These pits provide subsurface terminations for aircraft servicing facilities such as fuel lines, electrical power supply lines, air conditioning ducts, and other auxiliary services which are provided to aircraft that are on the ground. The use of subsurface pits serves to reduce the congestion of motorized vehicles and lines running across the aircraft servicing areas that would otherwise exist.

Aircraft servicing pits typically take the form of hollow, fiberglass enclosures that are buried in excavated holes dug beneath aircraft servicing areas. Fuel lines, electrical lines, air conditioning lines and other ground support auxiliary service lines are typically laid down during the construction of the airport or aircraft terminal in trenches that are ultimately filled in. These lines run from the terminal facility to the aircraft servicing pits and are accessible through aircraft servicing pit lid assemblies that are located at the upper entrances to the pits. The pit lid assemblies employ surrounding frames in which pit lids are mounted by hinges for upward rotation about horizontal axes of rotation.

In some conventional subsurface aircraft service pit lid assembly arrangements the hinges are located atop the frame and protrude upwardly above a flat deck forming the upper surface of the frame. While quite convenient and easy to construct, upwardly projecting hinge assemblies have significant disadvantages. The are highly susceptible to damage by snow plows and ground support vehicles traveling over the pit lit assemblies. Consequently, it is currently more common for pit lid hinge mechanisms to be located within the pit and below the flat, upper surface of the deck surrounding the pit opening.

While locating the pit lid hinge assembly within the pit itself avoids the problems associated with exposed pit lid hinge assemblies, conventional hinge arrangements of this type present other problems. Conventional pit lid hinge assemblies that are located within the confines of a pit are expensive and relatively complex in construction. They typically involve spring mechanisms and multiple lever arms that can become fouled or broken over time. Furthermore, the use of conventional subsurface hinge assemblies located within the confines of the pit itself presents an obstruction to access to the lines terminating within the pit. A portion of the access opening is necessarily blocked by such a hinge mechanism, thus making it more difficult for ground servicing personnel to enter or reach down into the pit. Also, these obstructions can cause injury to ground servicing personnel as then enter or leave the pit through the access opening.

SUMMARY OF THE INVENTION

The present invention involves a subsurface hinge assembly for an aircraft servicing pit that avoid the problems associated with both hinge assemblies the protrude from the upper surface of the lid frame and also hinge assemblies located within the pit itself. The hinge assembly for a pit lid according to the present invention provides a hinge pin located beneath the surface of the upper deck of the frame, but without occupying any space within the pit access opening itself. The pit lid hinge mechanism of the invention provides full clearance to personnel entering or reaching into the access opening within the frame. There is no spring mechanism obstructing entry into or egress from the pit enclosure, and there is no mechanism that occupies any space within the pit enclosure itself.

In one broad aspect the invention may be considered to be an aircraft pit lid assembly comprising a frame with a flat upper deck and defining a hinge pocket recessed beneath the deck, a lid having a flat upper surface with a hinge leaf projecting laterally outwardly from the lid, and a horizontally disposed hinge pin inserted transversely through the hinge leaf and which extends into upright pocket side walls in the recessed pocket in the frame. The horizontal hinge pin thereby form a horizontal axis of lid rotation relative to the frame that lies below the surface of the deck.

The frame is adapted for installation into a surface across which aircraft travel. The frame defines a frame access opening therethrough entirely within its structure. The access opening is surrounded by the flat, horizontal deck. A recessed bearing ledge beneath the deck encompasses the access opening. The hinge pocket that is recessed beneath the deck lies adjacent the access opening and has opposing, mutually upright pocket side walls extending downwardly from the deck. A hinge pocket floor is located between the upright pocket side walls and lies beneath the level of the deck. The pit lid itself has a flat upper surface and is formed of a size and shape that fits within the lateral confines of the deck to rest upon the bearing ledge.

The structure of the frame is bounded by a peripheral edge which extends a short distance vertically downwardly from the deck located therewithin. A straight, laterally extending bore is defined into the peripheral edge and into the structure of the frame parallel to and beneath the deck. The straight bore extends transversely across the hinge pocket so as to intersect the upright pocket side walls. A straight, transverse bore is also defined through the hinge leaf itself. The bores in the structure of the frame and through the hinge leaf are in coaxial alignment with each other. The hinge pin is thereby installed by insertion into the bore in the structure of the frame through a bore opening in the peripheral edge of the frame. The bore may extend entirely through the structure of the frame to thereby form a pair of bore openings at transversely separated locations on the peripheral edge of the frame. Alternatively, the bore may terminate within the structure of the frame and thereby form a single bore opening into the peripheral edge.

In most subsurface pit installations, the top opening of the pit is equipped with a pit liner that defines a flat, upper frame seating surface that extends about the periphery of the pit, and an upwardly projecting rim that forms the outer boundary of the seat for the pit lid frame. The frame of the pit lid assembly is lowered into position to rest upon the frame seat of the pit liner. The rim thereupon surrounds the peripheral edge of the structure of the frame and confines the pit lid frame therewithin. The rim resides in close proximity to the peripheral edge of the pit lid frame. Normally it resides in contact therewith throughout the entire circumference of the peripheral frame edge.

There is really no laterally acting force of any consequence that would tend to push the hinge pin longitudinally within the straight bore within the structure of the lid frame. Nevertheless, the upwardly projecting and surrounding rim of the pit liner effectively blocks the bore opening or openings in the peripheral edge of the frame, and thereby prevents the hinge pin from shifting in either direction along the longitudinal axis of lid rotation once the lid assembly has been seated in the pit liner.

It is important for the pit lid to have a moisture barrier seal at the access opening. In the absence of such a seal, the pit is likely to fill up with dirt and debris that would wash down into the pit access opening during rainy weather or with melting snow. To preserve the integrity of the seal it is highly desirable for the seal to make contact with the lid frame only at the last instance of closure, so that friction between the seal and the surrounding frame is reduced to a minimum.

This objective can be achieved with the pit lid assembly of the invention by forming the pit lid with a perimeter having a seal mounted thereon. The seal forms an enclosed loop that resides in a horizontal sealing plane that seals the pit access opening throughout its entire circumference when the pit lid rests upon the bearing ledge. The hinge pin and the horizontal bore into the structure of the pit frame in which the hinge pin is located, reside in a horizontal plane that is located between the sealing plane and the deck. By locating the hinge pin and the axis of hinge rotation between the sealing plane and the deck, the seal will leave contact with the frame with the first movement of lifting the lid from a closed position. There is therefore very little friction between the seal and the frame as the pit lid is opened and closed. Nevertheless, since the seal does establish contact with the frame at the final instant of closure, the necessary moisture sealing of the access opening is achieved.

Preferably the hinge pocket has an inclined end wall remote from the access opening. The hinge pocket end wall extends between the pocket side walls and is inclined at an obtuse angle, preferably about one hundred twenty degrees, relative to the deck of the pit lit assembly frame. The hinge leaf has a flat upper surface the meets the hinge pocket end wall in surface-to-surface contact when the pit lid is rotated upwardly about the axis of lid rotation to a maximum extent away from the access opening. This construction has several advantages.

The pit lid hinge leaf must have a thickness less than the thickness of the pit lid itself. By making the hinge leaf with a flat upper surface and by locating the hinge pin such that the flat upper surface of the hinge leaf meets the hinge pocket end wall in surface-to-surface contact throughout, a line of stress across the neck of the hinge leaf is avoided. Such a line of stress could result in a fracture of the hinge leaf with repeated use over time, breaking it at its junction with the pit lid. The transition between the hinge leaf and the pit lid is preferably curved so as to provide further strength and avoid a potential fracture line across the hinge leaf.

Another advantage of constructing the hinge leaf and the hinge pocket with flat surfaces that meet in face-to-face contact is that when the pit lid is opened, the flat upper surface of the hinge leaf approaches the hinge pocket end wall in such a manner as to squeeze out debris that may have collected in the hinge pocket between the inclined end wall and the hinge leaf. At airports there is a very significant amount of airport dirt formed of rubber, weeds, and jet fuel. This material accumulates in virtually any recessed surface at the airport, and tends to collect in crevices and cracks. Consequently, there is a considerable likelihood that airport dirt will collect in the hinge pocket at the hinge axis where the hinge leaf is connected by the hinge pin to the pit lid frame.

Preferably the surface of the hinge leaf is flat and meets the end wall surface of the hinge pocket in face-to-face contact throughout as the pit lid is opened to a maximum position at an obtuse angle relative to the plane of the deck of the frame. By constructing the hinge assembly so that the upper surface of the hinge leaf meets the end wall of the leaf pocket in a surface-to-surface contact, a self-cleaning hinge joint is created. That is, as the hinge leaf opens and the angle between the approaching upper surface of the hinge leaf on the stationary end wall of the hinge pocket grows smaller, the airport dirt is squeezed out of the diminishing space between the hinge leaf and the pocket end wall. Since many aircraft service pit lid assemblies remain closed and are not accessed for long periods of time, this self-cleaning feature is important, since it prevents the hinge joint from becoming jammed after a prolonged period of nonuse.

The hinge assembly of the invention is very advantageous because it does not occupy any space within the enclosure of the pit. Rather, the hinge mechanism is set into the structure of the frame at the hinge pocket defined therein.

The invention may be described with greater clarity and particularity by reference to the accompanying drawings.

DESCRIPTION OF THE EMBODIMENTS

Figure 1:
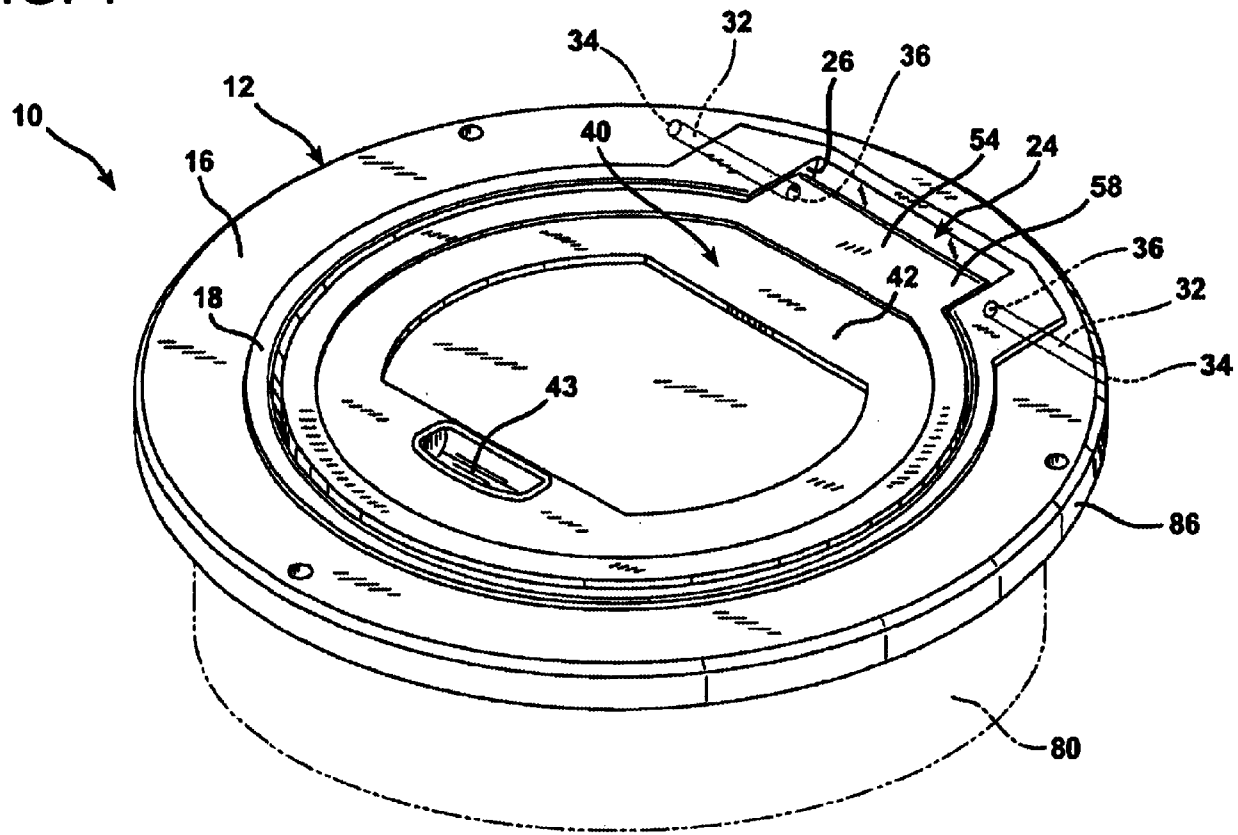
FIG. 1 is a perspective view of a preferred embodiment of the aircraft servicing pit lid hinge assembly of the invention shown with the pit lid closed.
Figure 2:
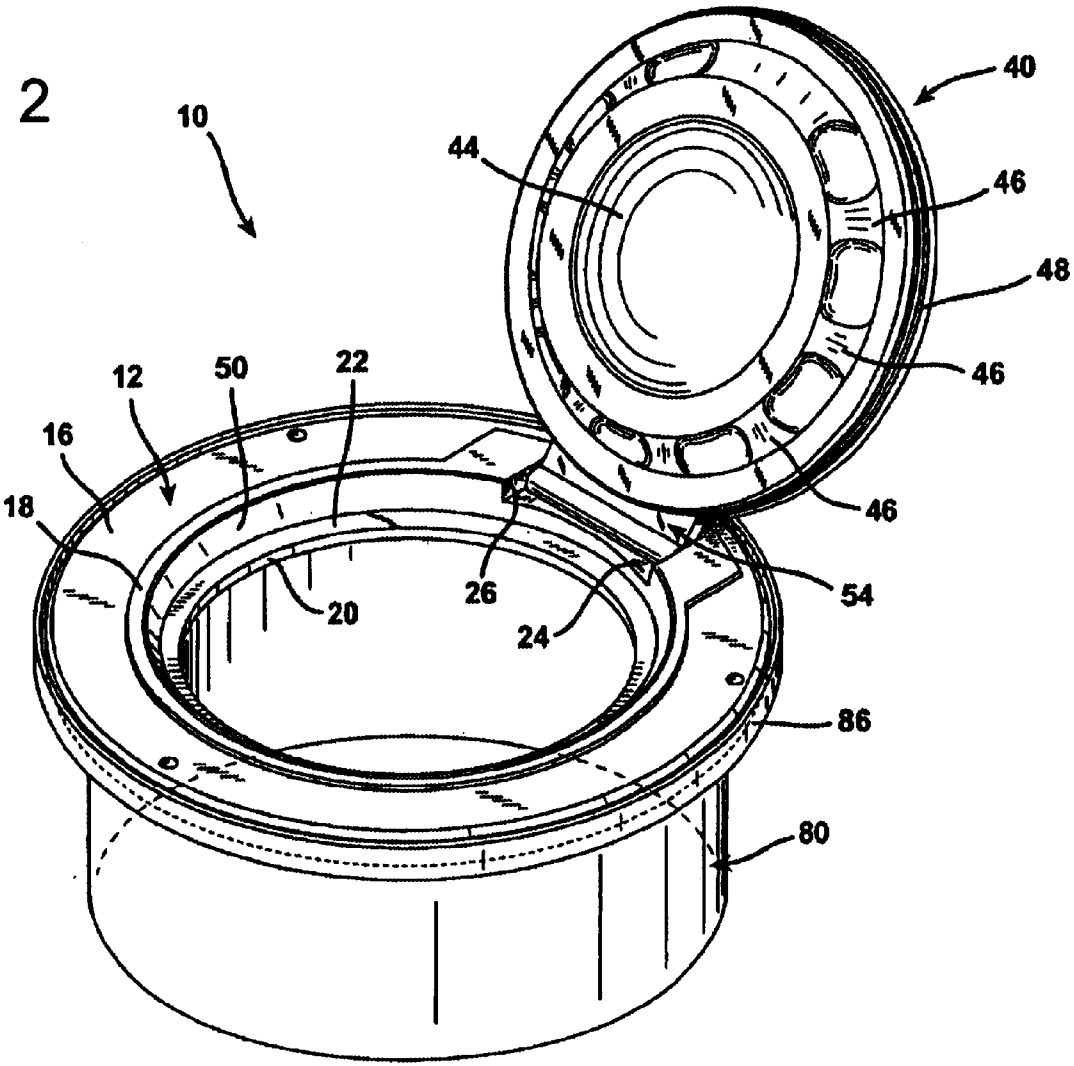
FIG. 2 is a perspective view of the lid assembly of FIG. 1 showing the pit lid in a completely open position.

FIGS. 1 and 2 illustrate an aircraft service pit lid assembly 10 according to the invention. The pit lid assembly 10 is comprised of a lid frame 12 adapted for installation into a surface across which aircraft travel. In the embodiment illustrated in FIGS. 1 and 2, the lid frame 12 is of a circular, annular configuration, although pit lid frames are also formed in square and rectangular configurations as well. The lid frame 12 defines a perimeter with a short, upright, cylindrical wall or edge 14, visible in FIG. 3. The structure of the lid frame 12 also forms a flat, horizontal deck 16 and a raised ring 18 that extends about the inner perimeter of the deck 16 and which forms a water dam obstruction that inhibits the flow of water from the deck 16 down into a central, circular access opening 20.

Figure 3:
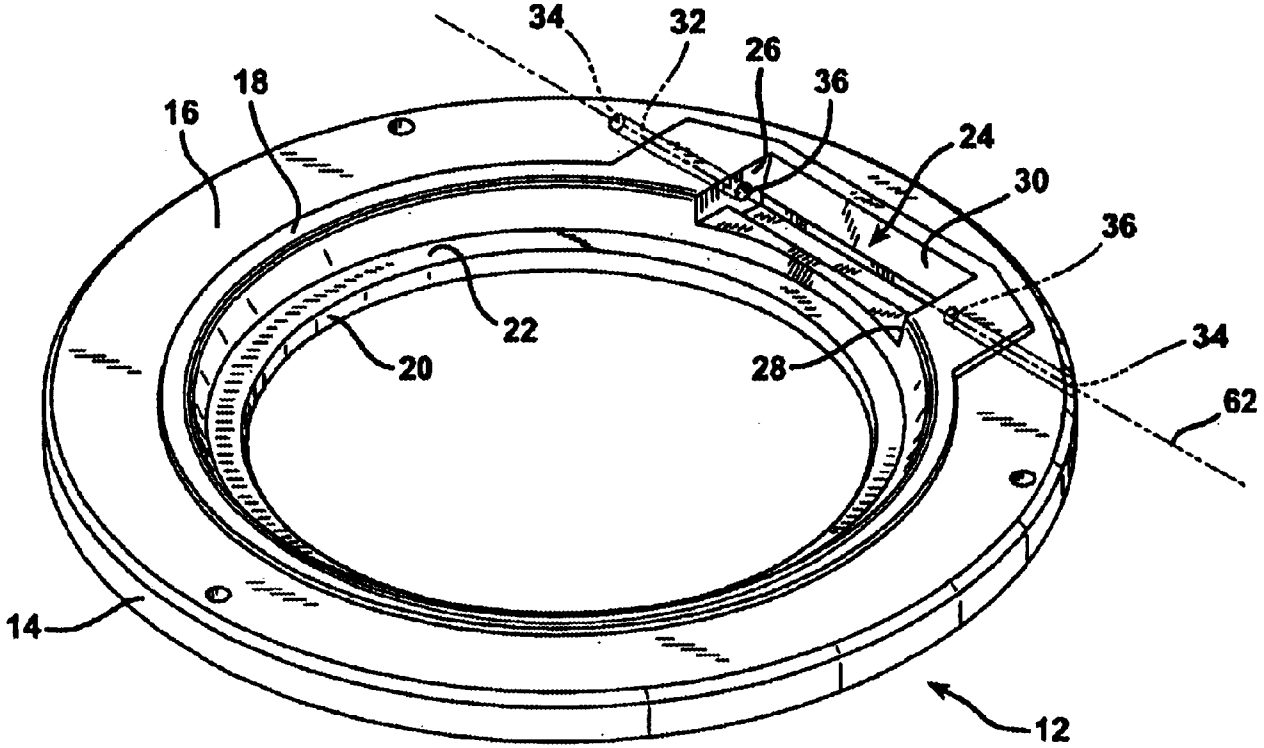
FIG. 3 is perspective view showing the pit lid frame in isolation from the lid and the hinge leaf.
Figure 5:
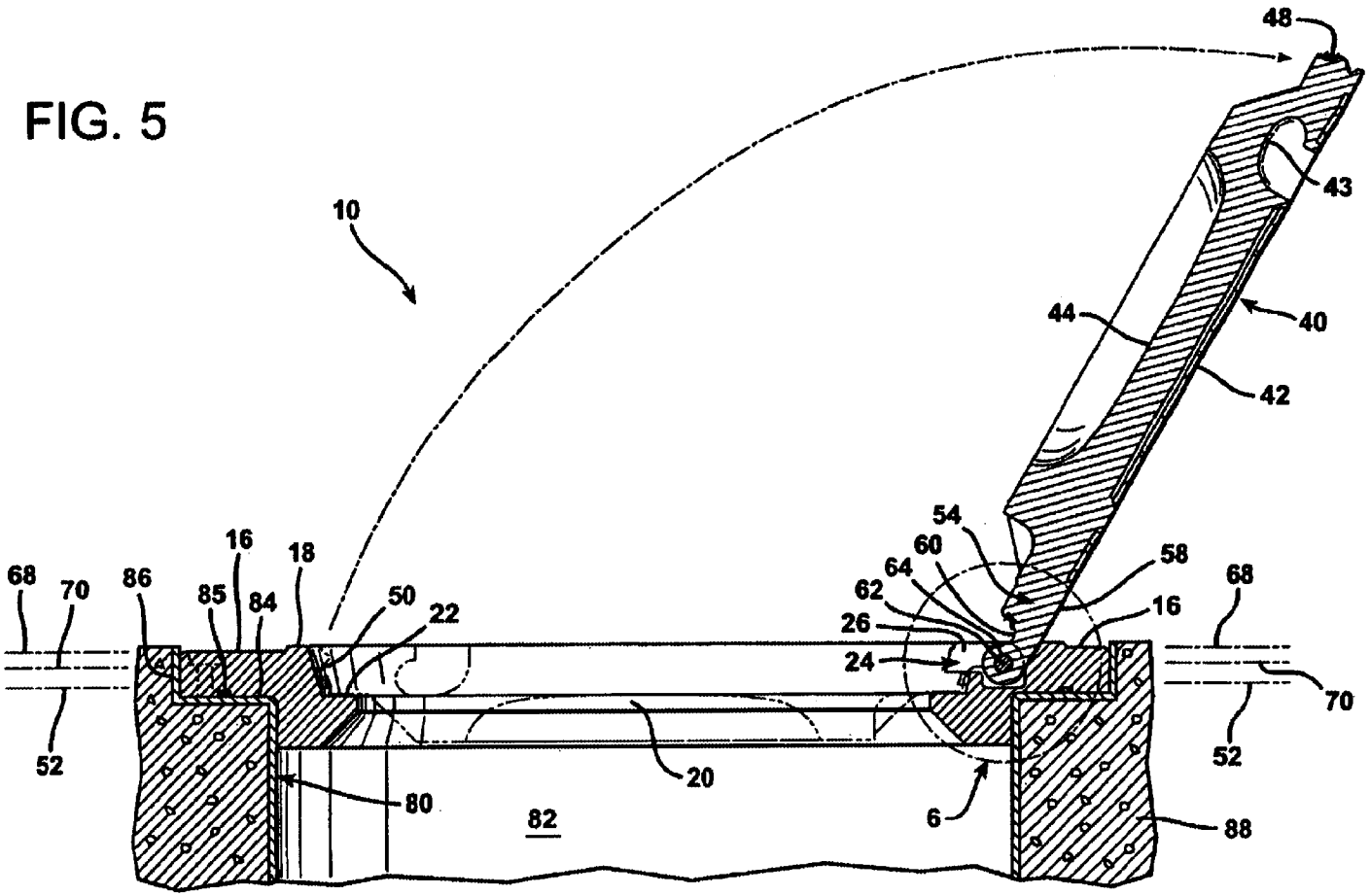
FIG. 5 is a side sectional view illustrating the pit lid in the opened condition, as shown in FIG. 2.
Figure 6:
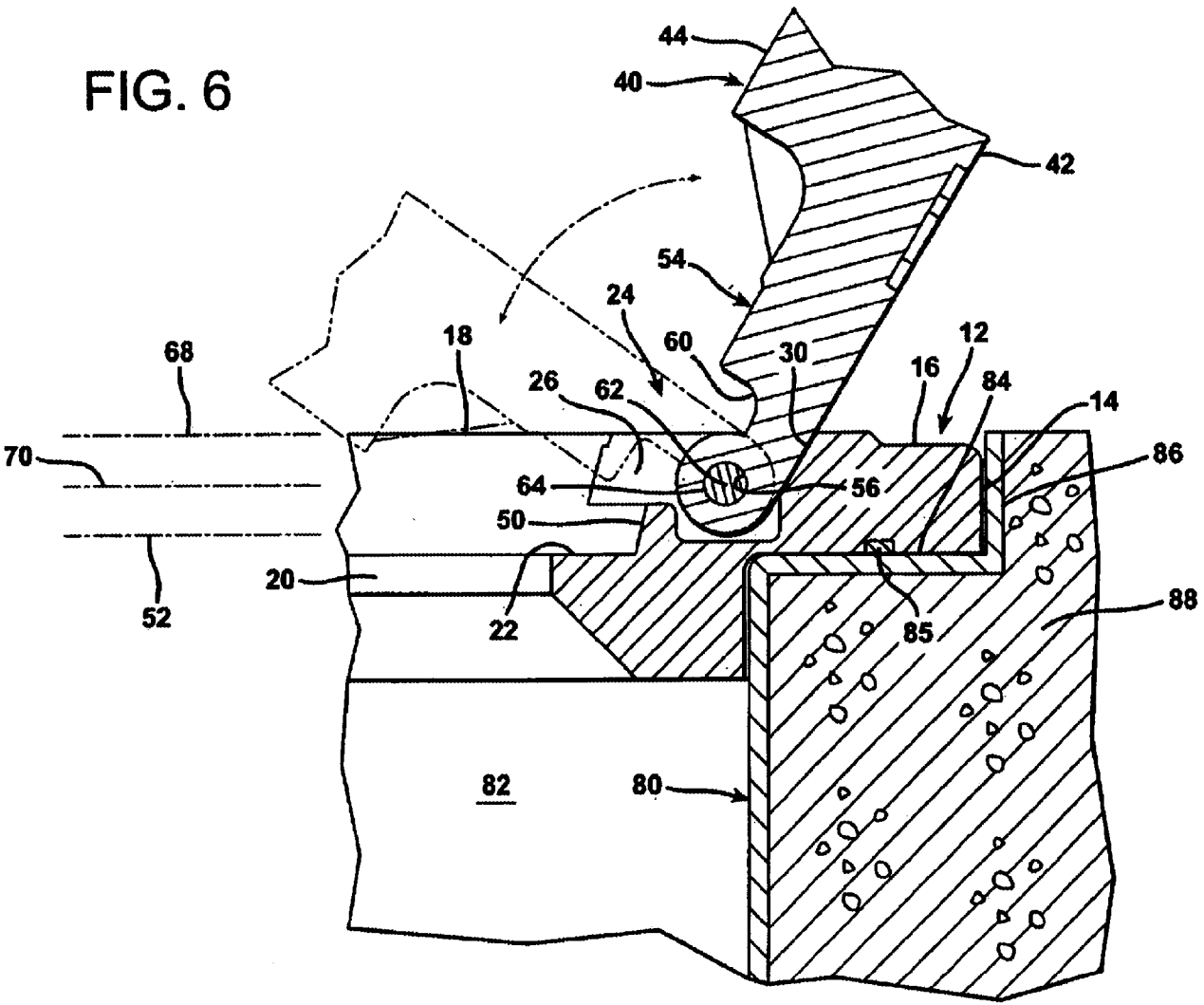
FIG. 6 is a sectional detail indicated at 6 in FIG. 5.

The access opening 20 is encompassed within a low, annular, upwardly facing peripheral bearing ledge 22 surrounded by and set beneath the deck 16. A slightly frustoconical-shaped wall surface 50 extends upwardly and outwardly from the bearing ledge 22 to the raised ring 18. The structure of the frame 12 is also formed with a hinge pocket 24 that is adjacent the access opening 20. As best illustrated in FIG. 3, the hinge pocket 24 defines a pair of vertical, opposing, mutually parallel pocket side walls 26 and 28, and an inclined end wall 30 remote from the access opening 20. As shown in FIG. 3, the end wall 30 extends between the pocket side walls 26 and 28 and is inclined at an obtuse angle of one hundred twenty degrees relative to the surrounding deck 16, as illustrated in FIGS. 5 and 6.

The structure of the frame 12 is further formed with a straight, narrow, horizontally extending, cylindrical bore 32 that may be 0.516 inches in diameter. The bore 32 extends across the structure of the frame 12 and is accessible from access openings 34 at transversely separated locations on the upright peripheral wall 14 of the frame 12. The bore 32 could be formed as a blind bore, but preferably extends entirely across the structure of the frame 12 as a complete cord of a circle. As illustrated in FIG. 3, the bore 32 extends through both of the pocket side walls 26 and 28 of the hinge pocket 24, forming bore openings 36 therein.

The pit lid assembly 10 is also formed with a generally disc-shaped pit lid 40 which has a flat, generally circular upper exposed surface 42 and a concave, dished out undersurface 44 with reenforcing ribs 46 extending radially toward its periphery. A conventional hand grip recess 43 is normally formed in the flat, upper surface 42 of the pit lid 40. At the edge perimeter proximate the undersurface 44 of the lid 40, there is a resilient, annular rubber moisture sealing gasket 48 set into a corresponding annular recessed peripheral channel defined into the structure of the lid 40. The moisture sealing gasket 48 establishes contact with the frustoconical surface 50 extending from the ring 18 of the frame 12 down to the bearing ledge 22 when the lid 40 is in the closed position depicted in FIG. 1. In this position, the pit lit 40 is seated upon the bearing ledge 22. When the pit lid 40 is closed, as shown in FIG. 1, the circular sealing gasket 48 resides in a horizontal sealing plane 52, indicated in FIGS. 5 and 6.

Figure 4:
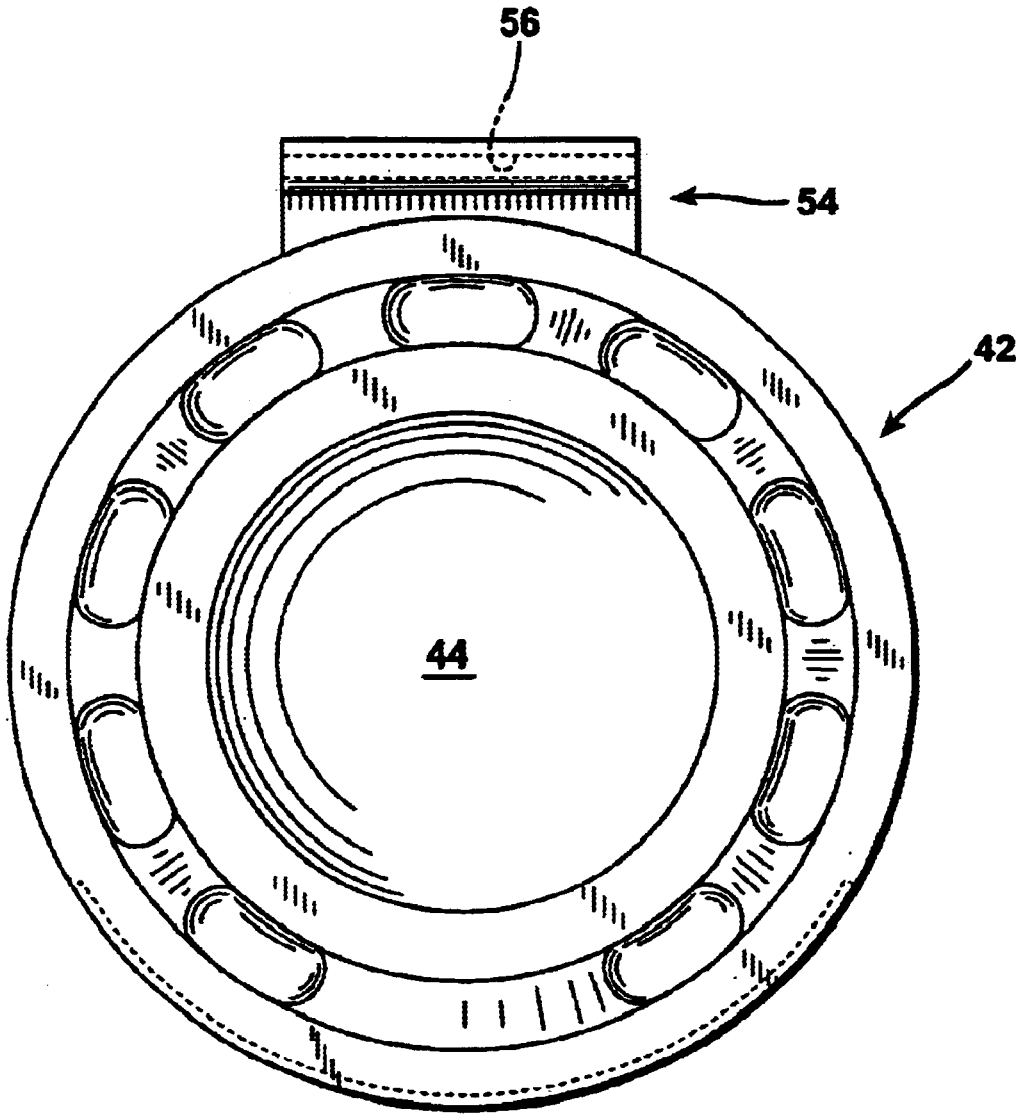
FIG. 4 is a bottom plan view of the pit lid and hinge leaf shown in isolation from the frame of the pit lid assembly.

A hinge leaf 54 that is thinner than the generally disc-shaped pit lid 40 projects from the pit lid 40 radially outwardly and into the hinge pocket 24. The hinge leaf 54 is preferably about eight inches in width and projects radially outwardly from the lid 40 a distance of between about two and three-quarters and three inches. A straight, narrow, cylindrical bore 56, shown in FIG. 4, is defined entirely through the structure of the hinge leaf 54. The bore 56 has a diameter of 0.516 inches and is in coaxial alignment with the bore 32 formed into and through the structure of the frame 12. The hinge leaf 54 has a flat upper surface 58 and an undersurface that is curved with a one-quarter inch radius at its transition and intersection with the lid 40. The arcuately curved transition between the hinge leaf 54 and the lid 40 is indicated at 60 in FIGS. 5 and 6. The pit lid 40 and the hinge leaf 54 are formed together as a single, cast structure.

A straight, cylindrical hinge pin 64, one-half of an inch in diameter, is inserted into one of the bore openings 34 and into the bore 32 in the frame 12. The hinge pin 64 extends entirely through the bore 56 in the hinge leaf 54 and extends through both of the bore openings 36 in the opposing pocket side walls 26 and 28. That is, the hinge pin 64 is long enough so that it passes entirely through the structure of the hinge leaf 54, throughout the length of the bore 56 therethrough, into the openings 36 in the pocket side walls 26 and 28, and into the adjacent structure of the frame 12. The hinge pin 64 thereby forms a horizontal axis of rotation 62 for the pit lid 40 relative to the frame 12.

It should be noted that the bores 32 and 56 that pass through the frame 12 and the hinge leaf 54, respectively, are located at the same level below the deck 16, but are both slightly above the sealing plane 52. The level of the deck 16 is indicated by the plane 68 in FIGS. 5 and 6, while the bores 32 and 56 and the hinge pin 64 lie at the level of the plane 70, also illustrated in FIGS. 5 and 6. Since the axis of rotation 62 of the hinge pin 64 is located in the horizontal plane 70 between the sealing plane 52 and the plane 68 of the deck 16 of the frame 12, the sealing gasket 48 leaves contact the frustoconical side wall 50 above the bearing ledge 22 with the initial movement of the pit lid 40 as the lid 40 is lifted from the access opening 20. Conversely, the sealing gasket 48 does not make contact with the surface 50 until the last instant of closure. This minimized frictional contact or rubbing between the gasket 48 and the surface 50, thereby preserves the integrity of the seal formed by the sealing gasket 48.

As best illustrated in FIGS. 5 and 6, the flat, upper surface 58 of the hinge leaf 54 meets the pocket end wall 30 in surface-to-surface contact when the pit lid 40 is rotated upwardly about the axis of lid rotation 62 to a maximum extent away from the access opening 20. The flat end wall 30 of the hinge pocket 24 is inclined downwardly and inwardly relative to the deck 16 and extends between the pocket side walls 26 and 28 to form an obtuse angle of one hundred twenty degrees relative to the plane 68 of the deck 16.

When the pit lid 40 is rotated upwardly about the horizontal axis 62 to the same obtuse angle of one hundred twenty degrees relative to the deck 16, the flat, upper surface 58 of the hinge leaf 54 meets the hinge pocket end wall 30 in surface-to-surface contact therewith. This face-to-face contact spreads the vertical component of the weight of the lid 40 across a generally rectangular area of mutual contact between the upper hinge leaf surface 58 and the end wall surface 30. This tends to reduce stress concentration that would tend to fracture the cast structure forming the lid 50 and hinge leaf 54 at the transition 60 therebetween. Stress concentration is further avoided by forming the transition 60 between the pit lid 40 and the hinge leaf 54 with a one-quarter inch radius of curvature, as best indicated in FIG. 6.

A further feature of the hinge construction illustrated is that it is self-cleaning. Since the surfaces 58 and 30 meet in fact-to-face contact when the lid 40 is fully open, as illustrated in FIGS. 2, 5, and 6, the debris that collects in the hinge leaf pocket 24 is squeezed out of the pocket 24 as the flat, upper hinge leaf surface 58 approaches the stationary, inclined hinge pocket end wall surface 30. The airport dirt mixture of weeds, rubber, jet fuel, and possibly other substances is thereby extruded out from between the two surfaces 58 and 30 as the lid 40 approaches the fully opened position shown in FIGS. 2, 5, and 6.

Since the bore 32 extends entirely through the structure of the frame 12 forming the transversely separated bore openings 34, the hinge pin 64 can be driven entirely out of the structure, if replacement of the hinge pin 64 is ever necessary. However, during normal usage, there is no significant force acting upon the hinge pin 64 that would tend to dislodge it from its position within the bores 32 and 62. That is, there is no significant longitudinal force along the axis of rotation 62 during usage of the pit lid assembly 10.

Nevertheless, the hinge pin 64 is normally immobilized from any longitudinal movement by the typical seating installation of the lid assembly. The hinge assembly frame 12 is preferably seated within a pit access collar 80 having an upwardly projecting rim 86 that surrounds the pit frame 12 and prohibits any longitudinal shifting movement of the hinge pin 64 relative to the hinge leaf 54 or the lid frame 12. That is, the lid assembly 10 is normally seated within a pit access collar 80. The access collar 80 is located at the upper, open end of the enclosure 82 of the pit cavity and forms a circular, annular seating ledge 84 atop which the frame 12 rests in seated engagement therewith. The vertical rim 86 of the pit access collar 80 extends upwardly about the outer periphery of the frame seating ledge 84. The pit access collar

80 is normally seated in and atop concrete 88, as illustrated in FIGS. 5 and 6. A sealing gasket 85 prevents moisture from leaking down into the pit enclosure 82 in between the frame 12 and the seating collar 80.

The peripheral rim 86 of the pit access collar 80 forms a confining structure relative to the outer, vertical peripheral wall 14 of the lid frame 12. The encompassing rim 86 surrounds the peripheral edge or wall 14 of the frame 12 and forms an obstruction at the bore access openings 34 that prevents the hinge pin 64 from shifting laterally along the axis of rotation 65. As a consequence, there is a positive restraint that prevents any shifting of the hinge pin 64 in the normal pit lid assembly installation as illustrated in the embodiment shown.

Preferably, the hinge pin 64 is formed of 17-4 PH (precipitation hardening) stainless steel. The hinge pin 64 thereby resists wear and bending which could result in point loading at the frame 12 and at the hinge leaf 54.

Undoubtedly, numerous variations and modifications of the invention will become readily apparent to those familiar with subsurface aircraft servicing pit assemblies. Accordingly, the scope of the invention should not be construed as limited to the specific embodiment disclosed herein.

I claim:

1. An aircraft service pit lid assembly comprising:

a frame for installation into a surface across which aircraft travel and which defines a pit access opening therethrough entirely within its structure and said access opening is surrounded by a flat horizontal deck and said structure of said frame has a recessed bearing ledge beneath said deck encompassing said access opening and a hinge pocket is formed in said structure of said frame recessed beneath said deck adjacent said access opening and said hinge pocket has mutually opposing, upright pocket side walls extending downwardly from said deck and a hinge leaf pocket floor located between said upright pocket side walls and lying beneath the level of said deck, a lid having a flat upper surface and formed of a size and shape that fits within the lateral confines of said deck to rest upon said bearing ledge and a hinge leaf projects laterally outwardly from said lid and into said hinge pocket, and wherein said structure of said frame is bounded by an outer peripheral edge, and wherein a straight bore is defined into said peripheral edge and into said structure of said frame parallel to and beneath said deck and transversely across said hinge pocket so as to intersect said upright pocket walls, and a straight, transverse bore is defined through said hinge leaf, and said bores in said structure of said frame and through said hinge leaf are in coaxial alignment with each other, and a horizontally disposed hinge pin inserted transversely into said transverse bore through said hinge leaf and which extends through said upright pocket side walls and into said bore in said structure of said frame to thereby form a horizontal axis of lid rotation relative to said frame that is beneath the level of said deck.

2. An aircraft service pit lid assembly according to claim 1 further comprising a pit liner having a rim that surrounds and confines said peripheral edge of said structure of said frame.

3. An aircraft service pit lid assembly according to claim 1 wherein said pit lid has a perimeter with a seal mounted thereon, and said seal forms an enclosed loop that resides in a horizontal sealing plane and seals said pit access opening throughout its entire circumference when said pit lid rests upon said bearing ledge, and said hinge pin resides in a horizontal plane that is located between said sealing plane and said deck.

4. An aircraft service pit lid assembly according to claim 1 wherein said pocket has an inclined end wall remote from said access opening and extending between said pocket side walls, and said end wall is inclined at an obtuse angle relative to said deck, and said hinge leaf has a flat upper surface that meets said pocket end wall in surface-to-surface contact when said pit lid is rotated upwardly about said axis of lid rotation to a maximum extent away from said access opening.

5. An aircraft service pit lid assembly according to claim 1 wherein said pocket has a flat end wall inclined relative to said deck downwardly and inwardly between said pocket side walls and forming an obtuse angle relative to said deck and said hinge leaf has a flat upper surface that meets said pocket end wall in surface-to-surface contact therewith when said pit lid is rotated upwardly about said horizontal axis to said same obtuse angle relative to said deck.

6. An aircraft service pit lid assembly comprising:

a lid frame having structure defining a perimeter with upright peripheral walls, a flat upper deck, an access opening encompassed within an upwardly facing peripheral bearing ledge that is lower than and surrounded by said deck, and a hinge leaf pocket formed in said frame structure adjacent said access opening to define a pair of opposing pocket side walls, and a straight, narrow bore formed into said frame structure parallel to and beneath said deck and extending from at least one of said upright peripheral walls into said frame structure and through both of said pocket side walls;

a pit lid configured to seat atop said bearing ledge within said frame structure;

a hinge leaf projecting from said pit lid and into said hinge leaf pocket and having a straight bore defined entirely therethrough that is aligned and coaxial with said bore in said structure of said frame; and a straight hinge pin inserted into said bore in said frame structure and extending entirely through said bore in said hinge leaf to extend through both of said pocket side walls, whereby said hinge forms a horizontal axis of rotation for said pit lid relative to said frame that is below the level of said deck.

7. An aircraft service pit lid assembly according to claim 6 further comprising a pit liner having an upwardly projecting peripheral rim and said lid frame seats within said collar rim with said peripheral walls of said lid frame confined within said rim in close proximity thereto.

8. An aircraft service pit lid assembly according to claim 6 wherein said pit lid has an access opening seal that forms a closed loop that follows the shape of said access opening and said seal resides in a horizontal sealing plane parallel to and beneath said deck when said lid is seated on said bearing ledge, and said hinge pin resides in a horizontal plane located above said sealing plane and below said deck.

9. An aircraft service pit lid assembly according to claim 6 wherein said frame structure defines a flat pocket end wall sloping downwardly and inwardly between said opposing pocket side walls and said pocket end wall resides in a plane forming an obtuse angle relative to said deck and said hinge leaf has a flat upper surface that meets said pocket end wall in surface-to-surface contact therewith said pit lid is rotated fully open from said access opening.

10. An aircraft service pit lid assembly according to claim 9 wherein said pit lid is thicker than said hinge leaf and said hinge leaf has an undersurface that meets said pit lid at a curved transition therewith.

11. A lid assembly for a subsurface aircraft servicing pit comprising:

a lid frame having an outer peripheral edge and all upper surface forming a flat deck, an access opening through said frame and surrounded by the structure of said frame, a flat bearing ledge encompassing said access opening and lying parallel to and beneath the level of said deck, and a hinge pocket defined in said frame and extending outwardly from said access opening and defining mutually opposing pocket side walls, and wherein a straight, horizontal bore is defined in said frame extending from said peripheral edge thereof beneath the level of said deck whereby said bore defines mutually coaxial hinge pin openings in said hinge pocket side walls, a pit lid which seats in said frame upon said bearing ledge and which has a hinge leaf projecting outwardly away from said access opening, and a straight, horizontal hinge pin located beneath the level of said deck and extending through said hinge leaf and into said bore in said frame and into said hinge pin openings defined in said hinge pocket side walls.

12. A lid assembly according to claim 11 further comprising a pit liner having an encompassing upper rim and said lid frame is seated in said liner so that said encompassing rim surrounds said peripheral edge of said frame.

13. A lid assembly according to claim 11 wherein said hinge pocket has a flat end wall that slopes down between said pocket side walls from said deck and forms an obtuse angle relative to said deck, and said hinge leaf has a flat upper surface that meets said pocket end wall in face-to-face contact therewith when said pit lid is opened to reside at said same obtuse angle relative to said deck.

14. A lid assembly according to claim 13 wherein said pit lid is thicker than said hinge leaf and has an underside that meets said hinge leaf at a curved transition therewith.

15. A lid assembly according to claim 11 wherein said pit lid has a sealing gasket formed as a closed loop and which forms a moisture seal for said access opening and which resides in a horizontal sealing plane when said pit lid is seated upon said bearing ledge, and said hinge pin is located in a horizontal plane between said sealing plane and said deck of said frame.

* * * * *